United States Patent [19]

Sigler

[11] 4,017,133

[45] Apr. 12, 1977

[54] FIRE EXTINGUISHER ENCLOSURE

[76] Inventor: Eugene B. Sigler, 1920 Burnside, Sioux Falls, S. Dak. 57104

[22] Filed: Feb. 23, 1976

[21] Appl. No.: 660,341

[52] U.S. Cl. ..... 312/293; 312/204; 229/51 D; 206/498

[51] Int. Cl.[2] ..... B65D 25/54; A47B 77/18

[58] Field of Search ..... 312/204, 245, 293; 169/51–53; 206/498; 229/51 D, 51 SC

[56] References Cited

UNITED STATES PATENTS

| | | | |
|---|---|---|---|
| 2,711,942 | 6/1955 | Jacquet | 312/204 |
| 3,756,502 | 9/1973 | Swanson et al. | 229/51 D |
| 3,800,999 | 4/1974 | Serritella | 229/51 D |
| 3,942,669 | 3/1976 | Savage, Jr. | 312/204 |

*Primary Examiner*—Casmir A. Nunberg

[57] ABSTRACT

An enclosure for a fire extinguisher or the like adapted to support and enclose completely a fire extinguisher, but having a front panel which can be torn out along defined lines so that the extinguisher can be removed and used.

5 Claims, 2 Drawing Figures

FIRE EXTINGUISHER ENCLOSURE

BACKGROUND AND SUMMARY OF THE INVENTION

The use of portable fire extinguishers in many buildings and for many applications is encouraged by safety inspectors and by insurors. Such use requires that the extinguisher be readily at hand and easily available.

At the same time, because the extinguishers are readily portable, they are subject to pilferage and vandalism. This is especially true of the type of extinguisher which is hung from the wall on hangers or merely supported on an open shelf.

For some reason, the complete enclosure of the extinguisher appears to deter at least a substantial amount of pilferage. It would appear that those engaged in this type of theft at least hesitate before breaking into a cabinet. Therefore, the glass front cabinet with a frangible cover has been proposed for this purpose. Its disadvantage is that the shattered cover leaves sharp edged fragments on which the user of the extinguisher may readily cut a hand or wrist as he reaches for the extinguisher. This is especially possible because of the agitated state usually present in the person when he needs the extinguisher.

By my invention I provide a complete enclosure in which to place a portable fire extinguisher. By the provision of a panel, readily removable by tearing it from the container, I provide a fully enclosed container from which the extinguisher can not be removed without the destruction of the container, and yet one in which the destruction provides a fully safe opening through which the removal can be accomplished without danger to the person using the extinguisher.

FIGURES

DESCRIPTION

Figure 1:
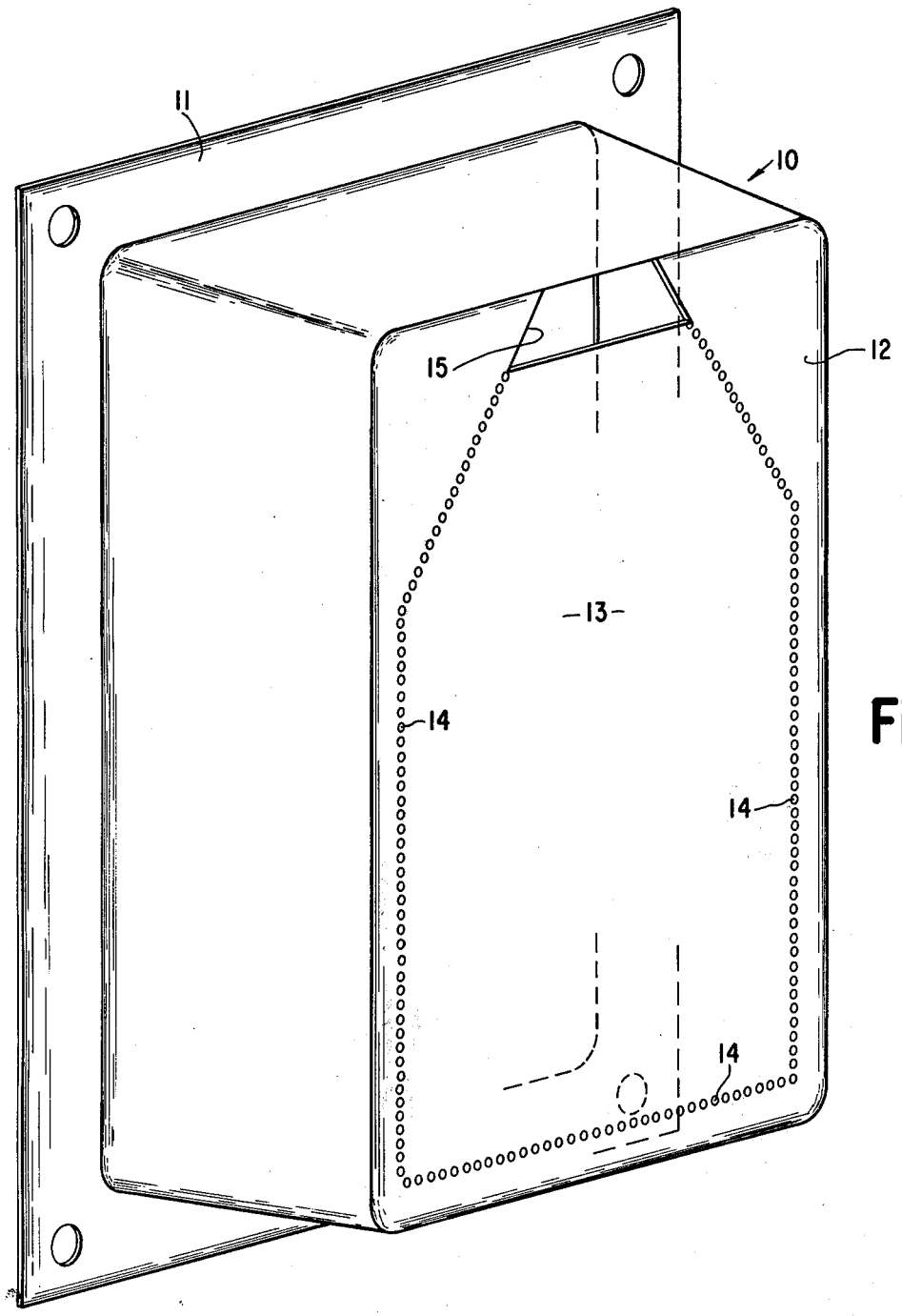
FIG. 1 is a pictorial view of the enclosure of my invention.
Figure 2:
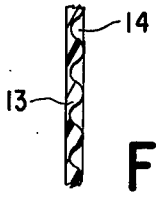
FIG. 2 is a partial sectional view along the tear-line of the front panel.

Briefly my invention comprises a box-like wall enclosure adapted to enclose and support a fire extinguisher or similar device against a wall. The front of the enclosure includes a removable panel which can readily be broken out so that the extinguisher can be removed.

More specifically and referring to the drawing, my invention comprises a box-like form, preferably molded of thermo-setting plastic material. The box shape 10 extends from a flange 11 which is adapted to be firmly attached to a wall. The rear, or flange side of the box shape is open so that an extinguisher or other device may be readily placed in the box formation.

On the front side 12, I provide a panel 13 outlined by depressions 14 extending not quite all the way through the material of the front of the box. These are readily molded into the front wall in the manufacture of the container.

Near the upper end of the front panel, I provide a small opening 15, large enough to receive a person's hand or at least four fingers of the hand. This opening is used to reach into and grasp the front panel so that the panel can be ripped out, thus laying the front of the box open. The extinguisher can then be readily removed for use.

The use of the molded depressions to outline the panel, and the use of a thermo-setting plastic material combine to provide an edge, after the panel is torn out, which does not have sharp corners or edges which are apt to cut or severely scratch the skin on the hand of the user. Thus, I provide an enclosure which will deter the casual thief from stealing the extinguisher while at the same time providing an enclosure from which the extinguisher can be easily removed when needed.

I claim:

1. An enclosure for a fire extinguisher or the like comprising a box-like structure having one open side, flanges on said structure adjacent said open side whereby said structure may be mounted on a wall, and a front panel readily removable from the front side of said box-like structure opposite the open side.

2. The device of claim 1 in which said panel is outlined by wall-weakening forms molded in said front side.

3. The device of claim 2 in which said wall weakening forms are dimple-like recessions molded into said front side adjacent said panel.

4. The device of claim 2 in which an opening is provided in said front side immediately adjacent said panel whereby the hand of an operator can reach into said structure to rip said panel from said structure.

5. The device of claim 3 in which said recessions reach nearly completely through the material of said front side.

* * * * *